US006711832B2

(12) United States Patent
Chen

(10) Patent No.: US 6,711,832 B2
(45) Date of Patent: Mar. 30, 2004

(54) SHOE HAVING A LID FOR COVERING A DRAIN HOLE

(76) Inventor: Eddie Chen, 9F, No. 201, Sec. 1, Taichung-Kang Rd., Taichung City (TW)

( * ) Notice: Subject to any disclaimer, the term of this patent is extended or adjusted under 35 U.S.C. 154(b) by 0 days.

(21) Appl. No.: 10/193,390

(22) Filed: Jul. 11, 2002

(65) Prior Publication Data

US 2004/0006889 A1 Jan. 15, 2004

(51) Int. Cl.[7] ..... A43B 7/10; A43B 7/08
(52) U.S. Cl. ..... 36/3 R; 36/3 B; 36/3 A
(58) Field of Search ..... 36/3 B, 3 R, 3 A

(56) References Cited

U.S. PATENT DOCUMENTS 418,966 A * 1/1890 Welander ..... 36/3 A
635,101 A * 10/1899 Kennedy ..... 36/3 B
660,603 A * 10/1900 Troxel ..... 36/3 B
752,254 A * 2/1904 Patton ..... 36/3 A
760,401 A * 5/1904 Sandmeyer ..... 36/3 R
1,168,166 A * 1/1916 Cook ..... 36/3 A
1,202,827 A * 10/1916 Gerhold ..... 36/3 R
1,223,042 A * 4/1917 Devlin ..... 36/3 A
1,392,350 A * 10/1921 O'Brien ..... 36/3 A
1,742,772 A * 1/1930 Langan ..... 36/3 B
1,971,223 A * 8/1934 Kamrass ..... 36/3 A
4,100,685 A * 7/1978 Dassler ..... 36/3 B
4,771,555 A * 9/1988 Ohashi ..... 36/3 R
4,835,883 A * 6/1989 Tetrault et al. ..... 36/3 R
5,357,689 A * 10/1994 Awai ..... 36/3 A

* cited by examiner

*Primary Examiner*—Ted Kavanaugh
(74) *Attorney, Agent, or Firm*—Brooks Kushman P.C.

(57) ABSTRACT

A shoe includes a hollow base fixed in a through-hole formed in the shoe. The hollow base provides a fluid passage for ventilation or drainage. A lid is attached removably to the hollow base to block the fluid passage. In an embodiment, a solid stud is mounted on the shoe adjacent to the hollow base to retain the lid when the lid is removed from the hollow base. The lid may be elongated and has two closure parts attachable removably and respectively to the hollow base and the stud in a bridging manner. Preferably, the lid is capable of being press-fitted to the hollow base and/or the solid stud. The lid not only functions to close the hollow base but also serves to hold a logo.

5 Claims, 15 Drawing Sheets

SHOE HAVING A LID FOR COVERING A DRAIN HOLE

BACKGROUND OF THE INVENTION

1. Field of the Invention

The invention relates to a shoe having vent or drain holes, more particularly, to a shoe having lids for covering vent or drain holes.

2. Description of the Related Art

Athletic shoes such as canvas sneakers and fishing shoes are usually provided with through holes below shank parts of an upper. These holes serve to ventilate the shoe, when the shoe is used in a dry area. When the shoe is used for activities such as, sailing and fishing, a large amount of water entering the shoe from the top of the shoe can be drained rapidly out of the shoe through the through-holes. However, since the through holes cannot be closed, water cannot be prevented from flowing into the shoe when the wearer walks in an area where the level of water is low, or cannot prevent sand or mud from entering the shoe when walking in a sandy or muddy area.

SUMMARY OF THE INVENTION

An object of the present invention is to provide a shoe with a lid which can be attached removably to a ventilating or draining hole for preventing undesirable solid particles from entering the shoe.

Another object of the invention is to provide a shoe with a lid which can be attached removably to a ventilating or draining hole and which also serves to carry a logo or an advertisement.

Accordingly, a shoe according to the present invention comprises: a shoe body including at least one through-hole extending from an inside to an outside of the shoe body; at least one hollow base fixed in said through hole and having an inner end at the inside of the shoe body and an outer end opposite to the inner end, the hollow base being hollow from the inner end to the outer end for passage of a fluid; and a lid attached removably to the hollow base so as to block the hollow base.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
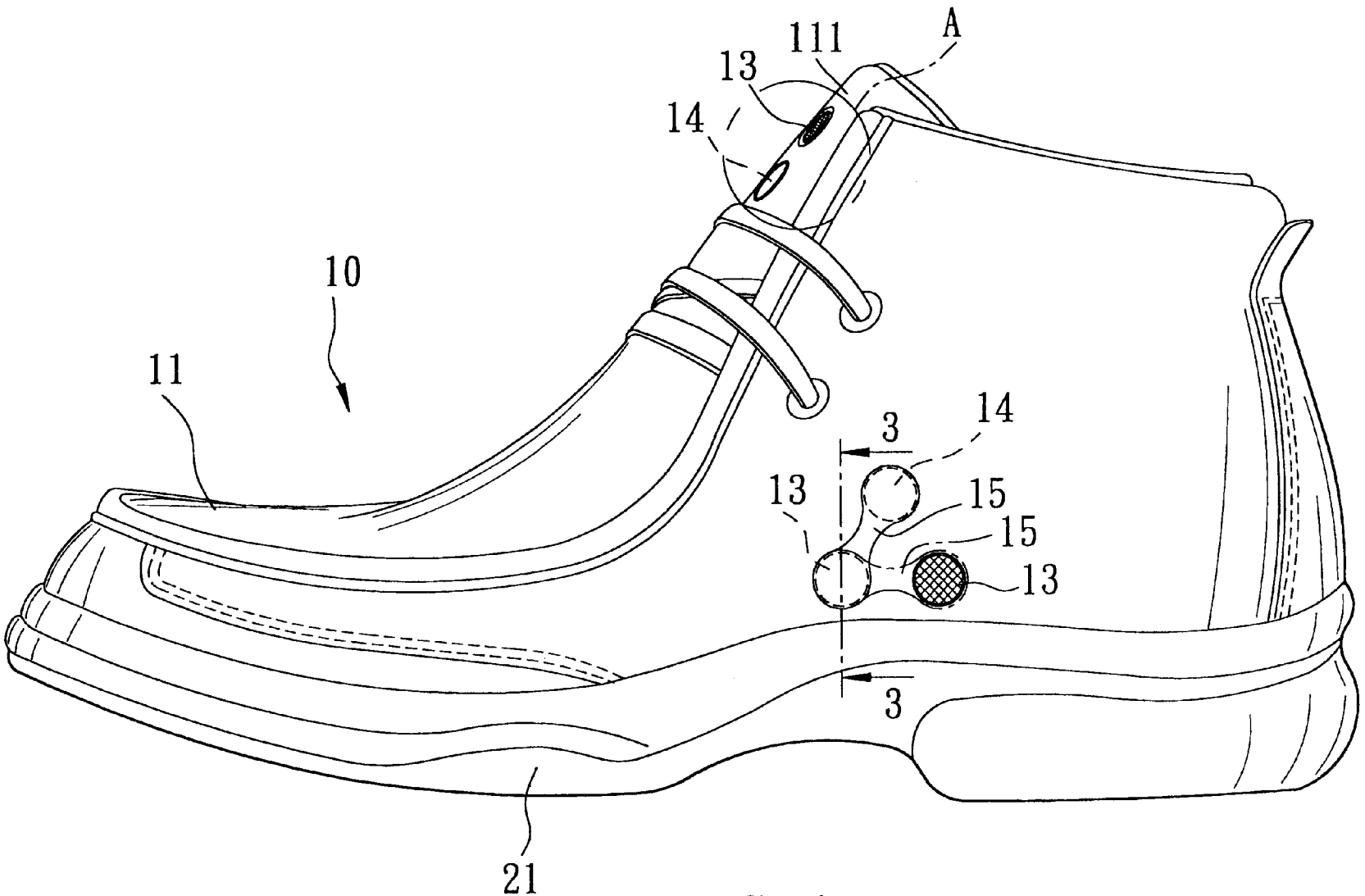
FIG. 1 is a side view of a shoe embodying the present invention.
Figure 2:
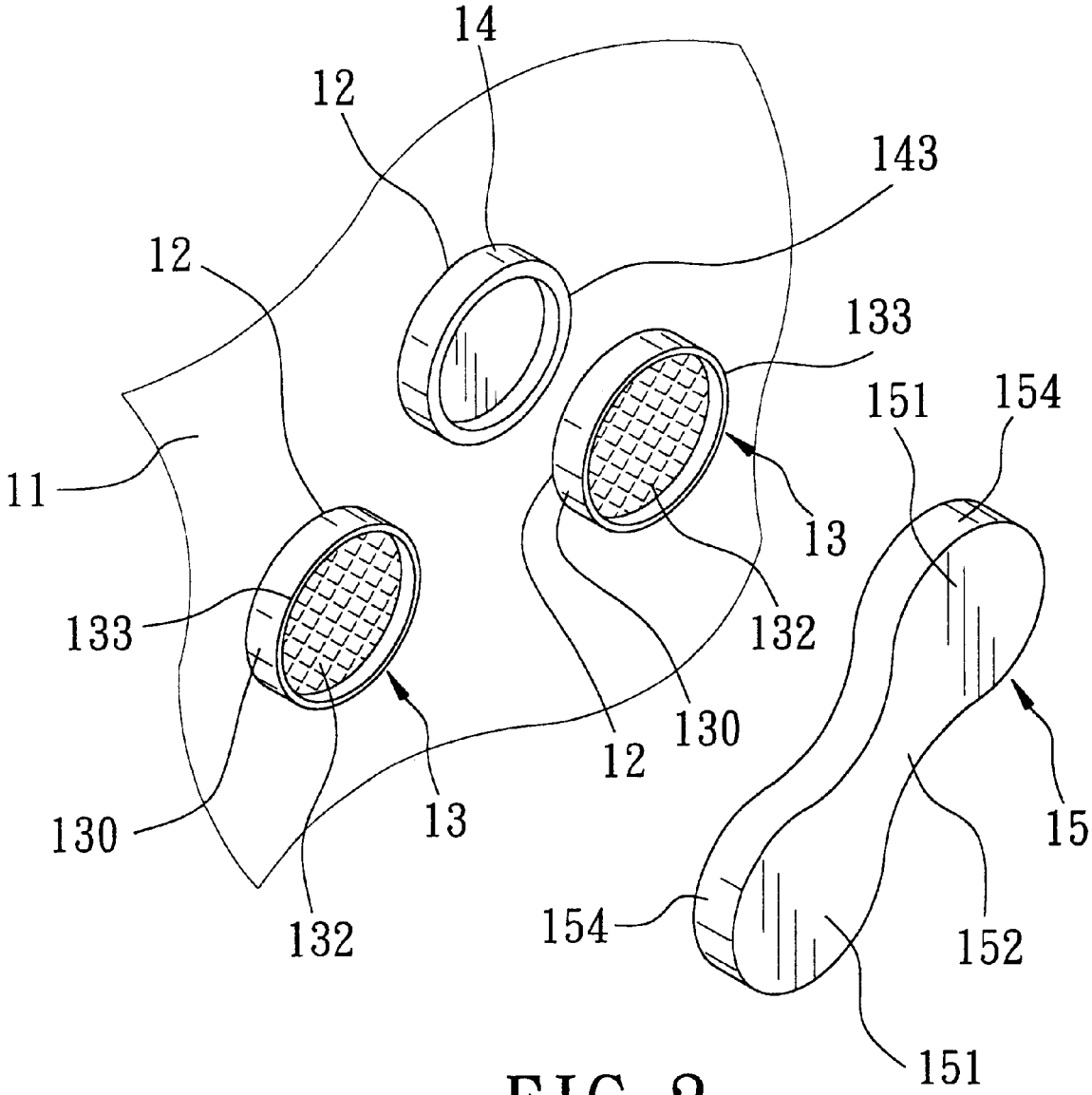
FIG. 2 is a fragmentary perspective view of the shoe of FIG. 1.
Figure 2A:
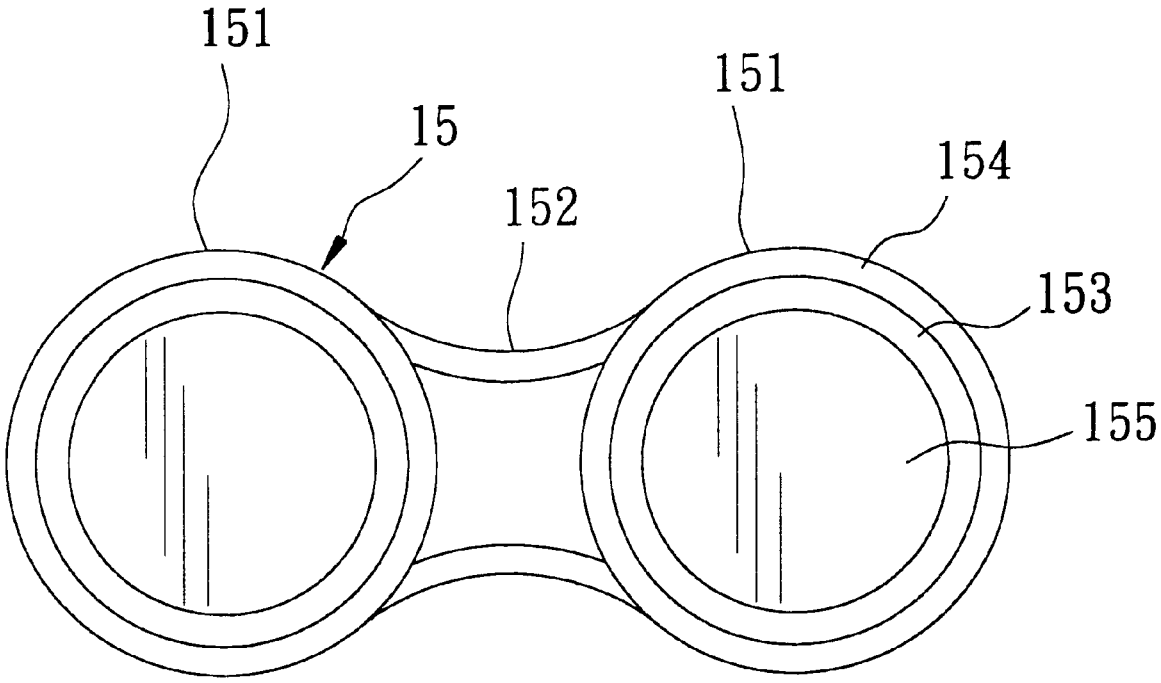
FIG. 2A is a plan view of a lid used in the shoe of FIG. 1.

The preferred embodiments of the present invention will be illustrated with reference to FIGS. 1 to 10 in which like elements are represented by like numerals.

Referring to FIGS. 1, 2, 2A and 3, a shoe embodying the present invention is shown to include a shoe body 10 which includes an upper 11 and an out sole 21. The upper 11 is formed with three through-holes 12 each of which extends from an inside to an outside of the shoe body 10. Two hollow bases 13 are fitted respectively in two of the through holes 12. Each hollow base 13 has a tubular wall 130 which is hollow from an inner end to an outer end thereof. The tubular wall 130 is formed with a flange 131 which abuts an inner surface of the upper 11 and which is fixed to the upper 11 via a sewing process, an end rim 133, and an integral screen member 132 extending across the hollow base 13. Instead of sewing, adhesive bonding may be used to fix the flange 131 to the upper 11. Numeral 30 represents a lining disposed inside the shoe body 10. A non-hollow or solid stud 14 is fitted in the remaining through-hole 12 and includes a lateral rim 143 and an inner flange (not shown) similar to the flange 131 of the hollow base 13. The two hollow bases 13 and the stud 14 are arranged at three locations which define substantially three vertices of an equilateral triangle.

Figure 3:
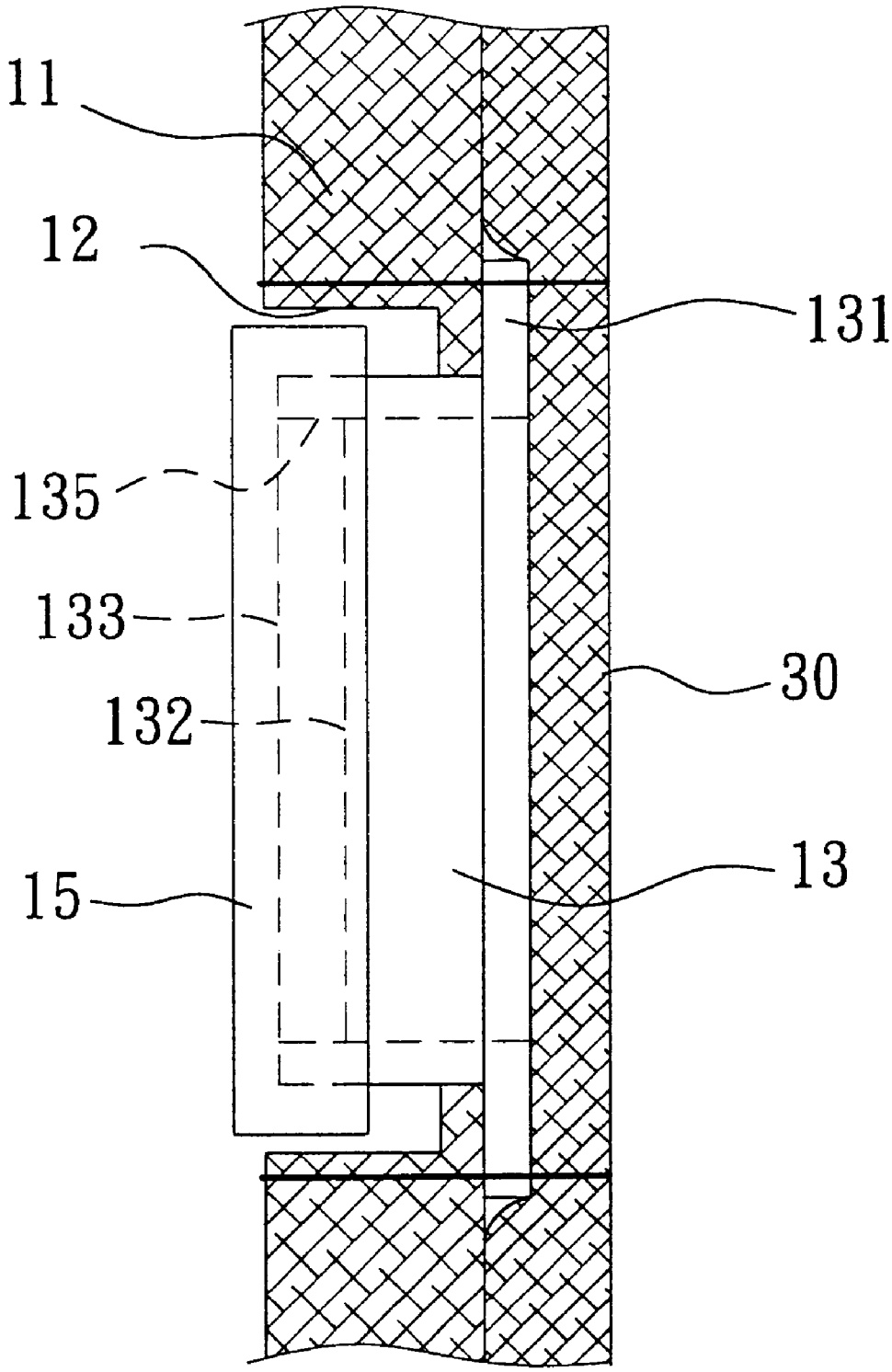
FIG. 3 is a fragmentary sectional view taken along line 3—3 of FIG. 1.

Since the hollow bases 13 are hollow, they serve to provide passages 135 (only one is shown in FIG. 3) for air ventilation or water drainage. The screen members 132 of the hollow bases 13 function to prevent solid particles from entering the shoe body 10. A lid 15 is provided to block or close the passages 135 of the hollow bases 13. The lid 15 is elongated and includes two closure parts 151 which are circular and which are interconnected via a connection part 152. Each closure part 151 is formed with a looped or annular groove 153 which is defined by an outer flange 154 and an inner circular raised part 155. The lid 15 can be press fitted simultaneously to both of the hollow bases 13, or to one of the hollow bases 13 and the stud 14. The annular groove 153 of each closure part 151 is to receive fittingly the lateral rim 143 of the stud 14, or the end rim 133 of one of the hollow bases 13.

The length of the lid 15 is arranged such that the lid 15 can be attached in a bridging manner to any two of the hollow bases 13 and the stud 14. In particular, the closure parts 151 of the lid 15 can be press-fitted respectively and removably to the end rims 133 of the two hollow bases 13, as shown by phantom lines in FIG. 1. In this situation, the two hollow bases 13 are blocked and closed by the lid 15. Alternatively, the closure parts 151 of the lid 15 may be attached removably and respectively to the end rim 133 of one of the hollow bases 13 and the lateral rim 143 of the stud 14, as shown in solid lines of FIG. 1. In this situation, the other hollow base 13 is in an open state and permits ventilation or water drainage. In order to drain water effectively, the lid 15 may also be removed from both of the hollow bases 13 and attached to the stud 14 with only one closure part 151 thereof. When it is desired to prevent water or solid particles from entering the shoe body 10, both hollow bases 13 may be closed by attaching the lid 15 to the hollow bases 13.

Figure 4:
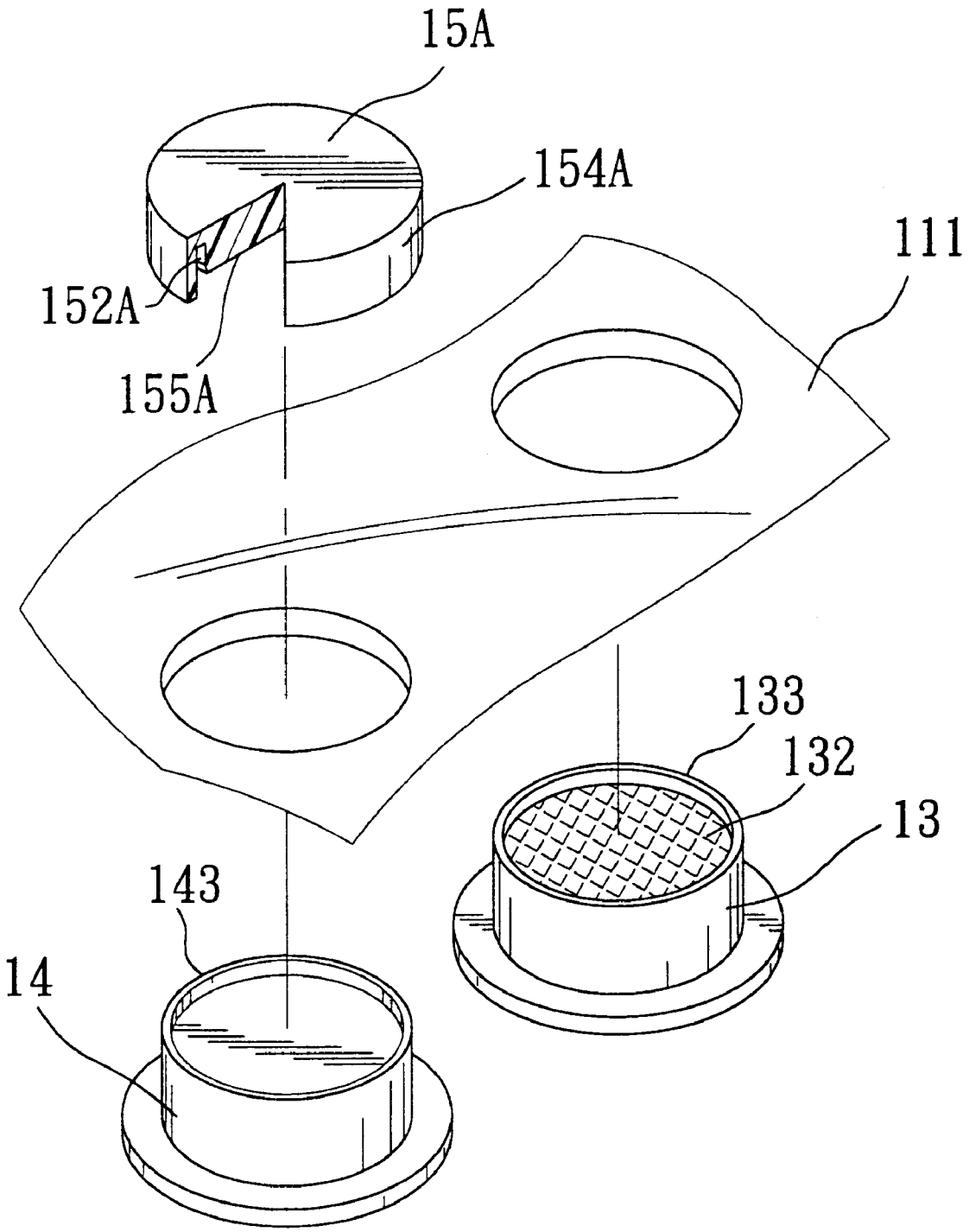
FIG. 4 shows an exploded view of a portion within a circle (A) in FIG. 1.

Referring to FIG. 4 in combination with FIG. 1, the upper 11 further includes one non-hollow or solid stud 14 and one hollow base 13 mounted on a tongue 111. When the hollow base 13 is to be placed in an open state, the stud 14 serves to retain a lid 15A which has a construction similar to one of the closure part 151 of the lid 15. Specifically, the lid 15A is circular and has an annular groove 152A defined by an annular flange 154A and a raised part 155A. The lid 15A can be press-fitted removably to the stud 14. When it is desired to close the hollow base 13, the lid 15A may be detached from the stud 14 and attached to the hollow base 13.

Figure 5:
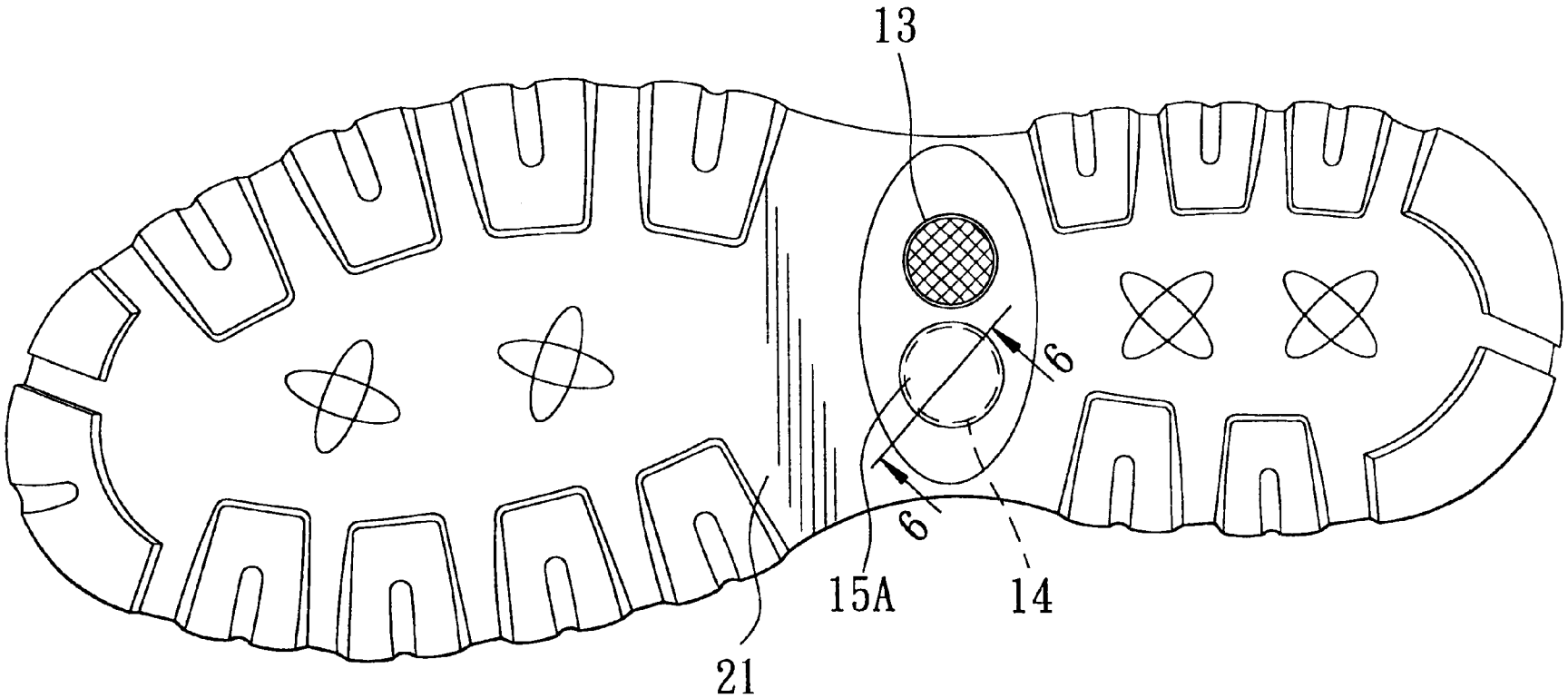
FIG. 5 is a bottom view of the shoe of FIG. 1.
Figure 6:
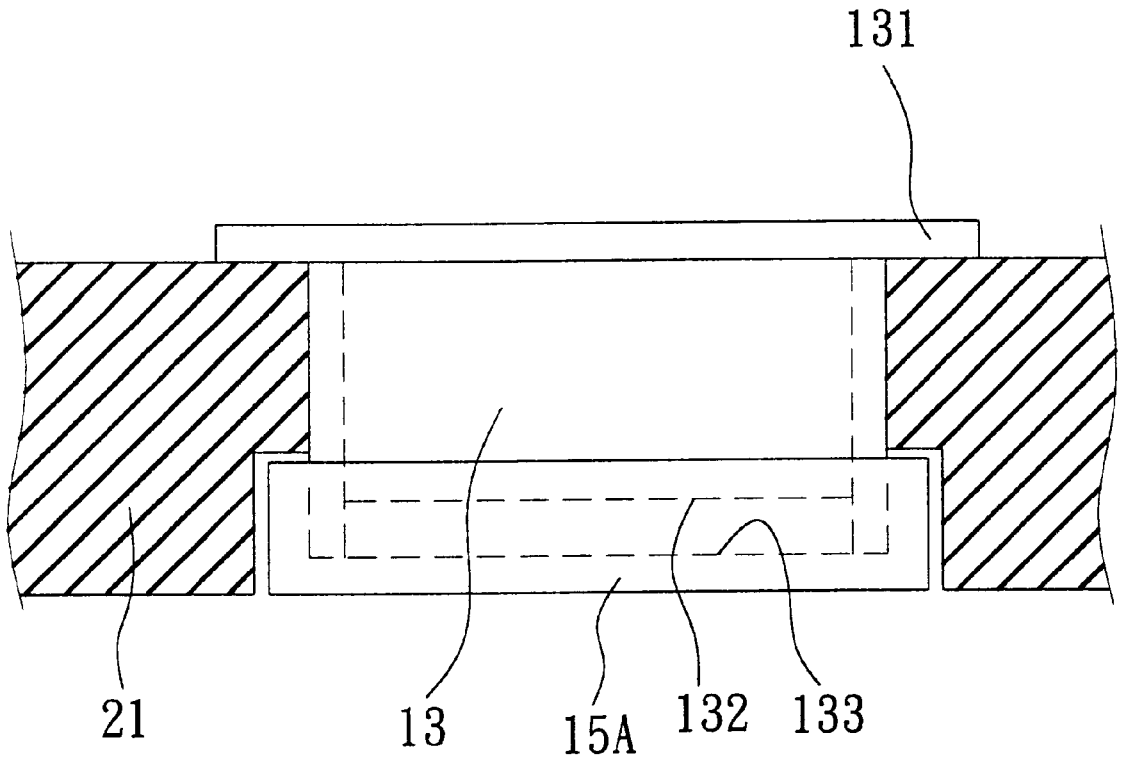
FIG. 6 is a sectional view taken along line 6—6 of FIG. 5.

Referring to FIGS. 5 and 6 in combination with FIG. 1, the outsole 21 is provided with a stud 14, a hollow base 13, and a lid 15A for attachment to the stud 14 or the hollow base 13. The hollow base 13 has a flange 131 abutting an inner surface of the outsole 21. The hollow base 13 may be assembled with the outsole 21 by bonding the hollow base 13 to the outsole 21 with an adhesive, or by placing the hollow base 13 in a mold during molding of the outsole 21.

Figure 7A:
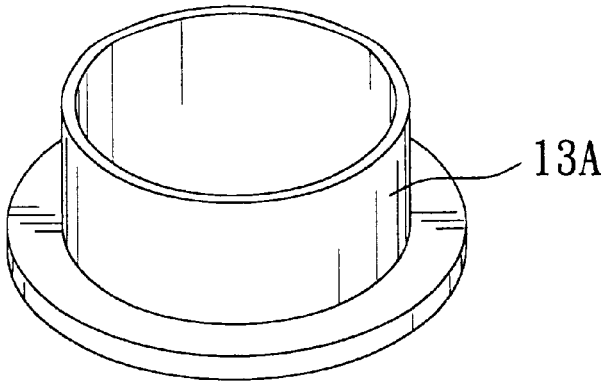
FIG. 7A is a perspective view of an alternative hollow base according to the present invention.
Figure 7B:
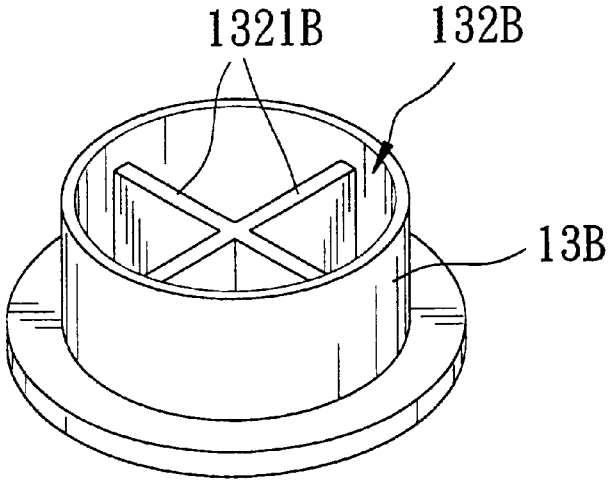
FIG. 7B is a perspective view of another alternative hollow base according to the present invention.

FIGS. 7A and 7B show respectively two alternative hollow bases 13A and 13B usable in the present invention. The hollow base 13A differs from the hollow base 13 in that it does not include any screen member extending across the hollow base 13A. The hollow base 13B differs from the hollow base 13 in that it has an integral screen member 132B which is defined by two intersecting ribs 1321B.

Figure 8:
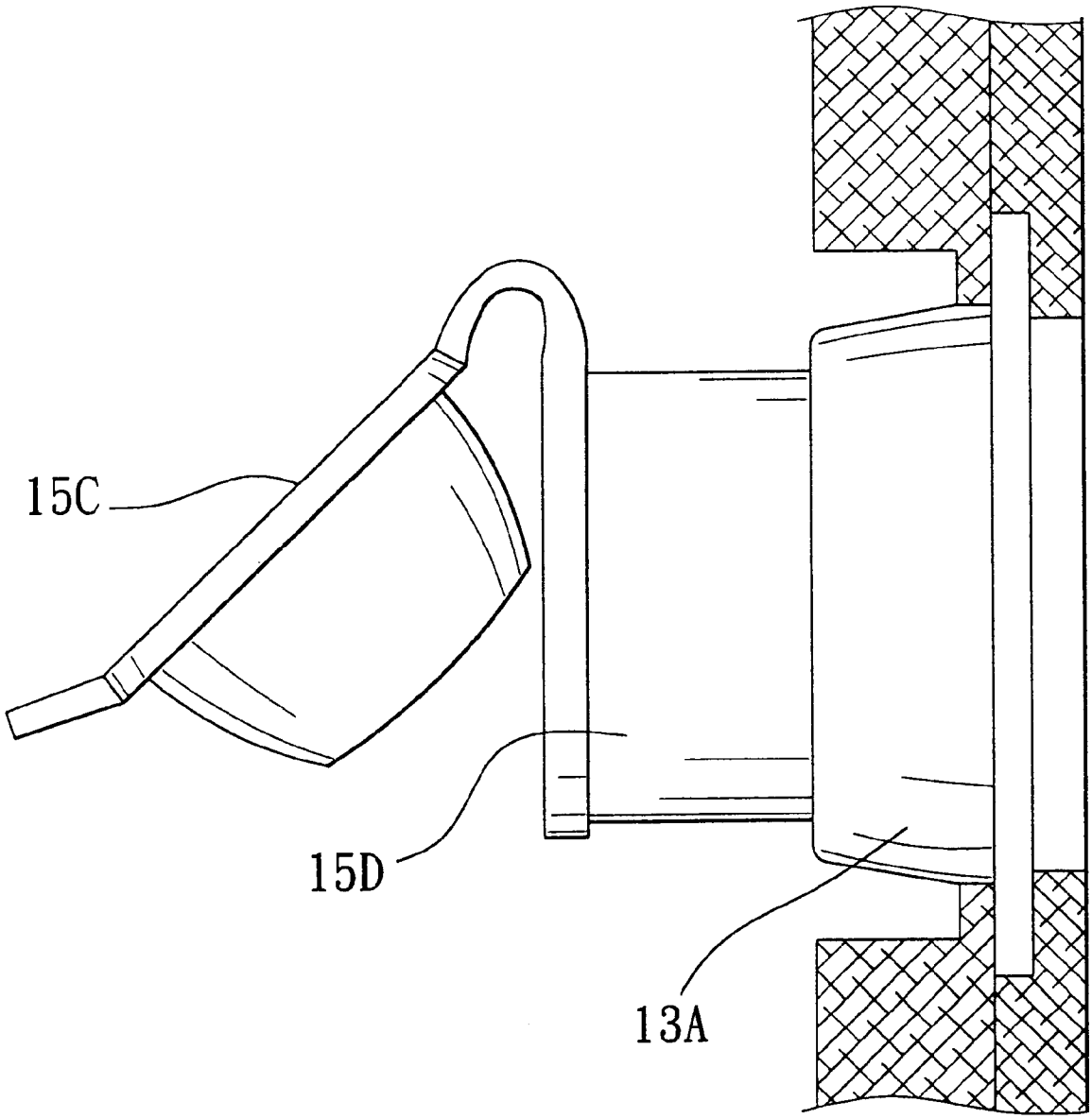
FIG. 8 is a sectional view showing the hollow base of FIG. 7A and a lid unit used therein.
Figure 9:
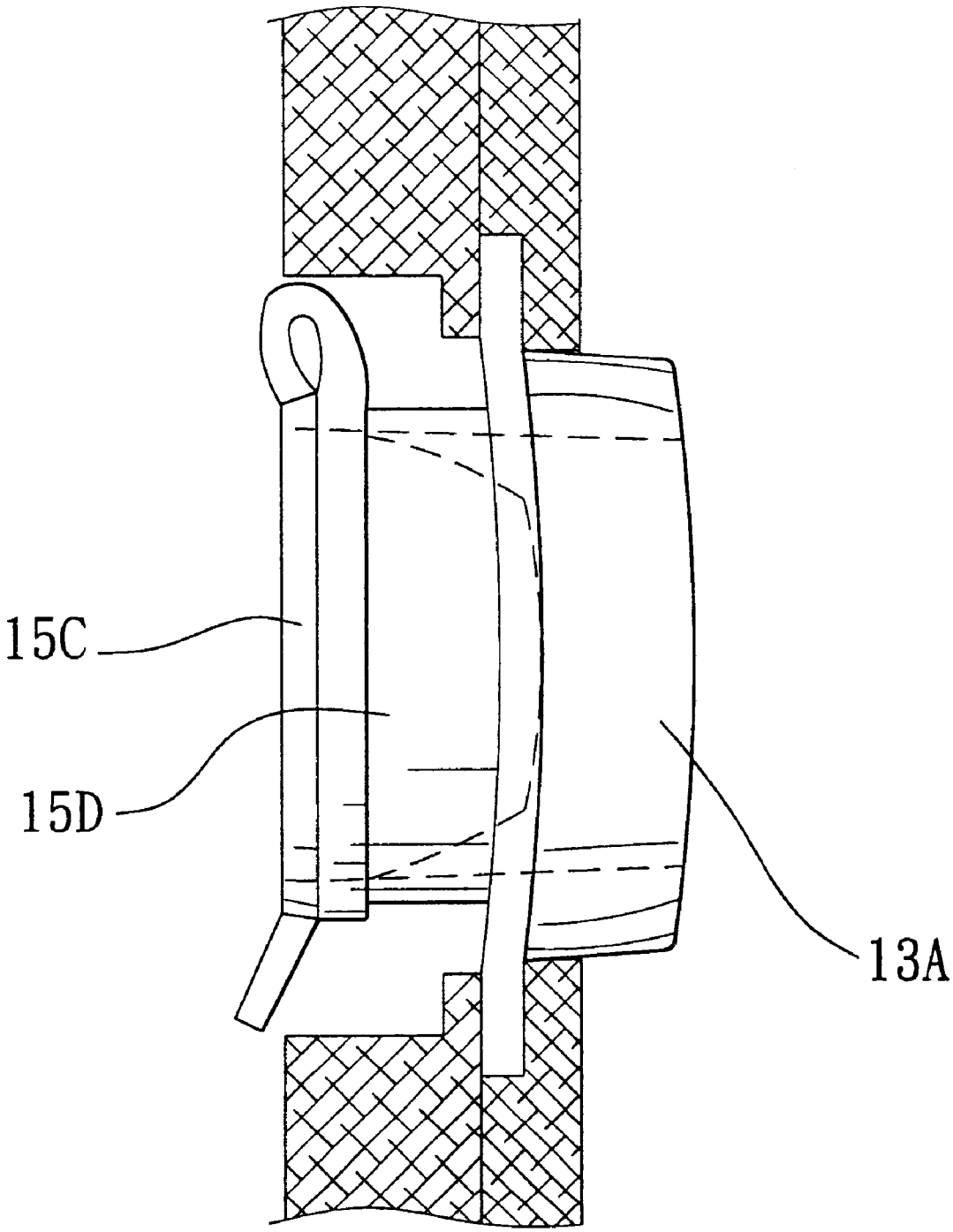
FIG. 9 is the same view as FIG. 8 but with the lid unit inserted completely into the hollow base.

Referring to FIGS. 8 and 9, the hollow base 13A may be closed by a lid which includes a lid body 15C and a lid holder 15D. The lid holder 15D is hollow and can be press-fitted in the hollow base 13A. The lid body 15C is hinged to the lid holder 15D. When the lid body 15C is plugged in the lid holder 15D, the lid holder 15D is closed. When the lid body 15C and the lid holder 15D are removed from the hollow base 13A, the hollow base 13A is opened.

Figure 10:
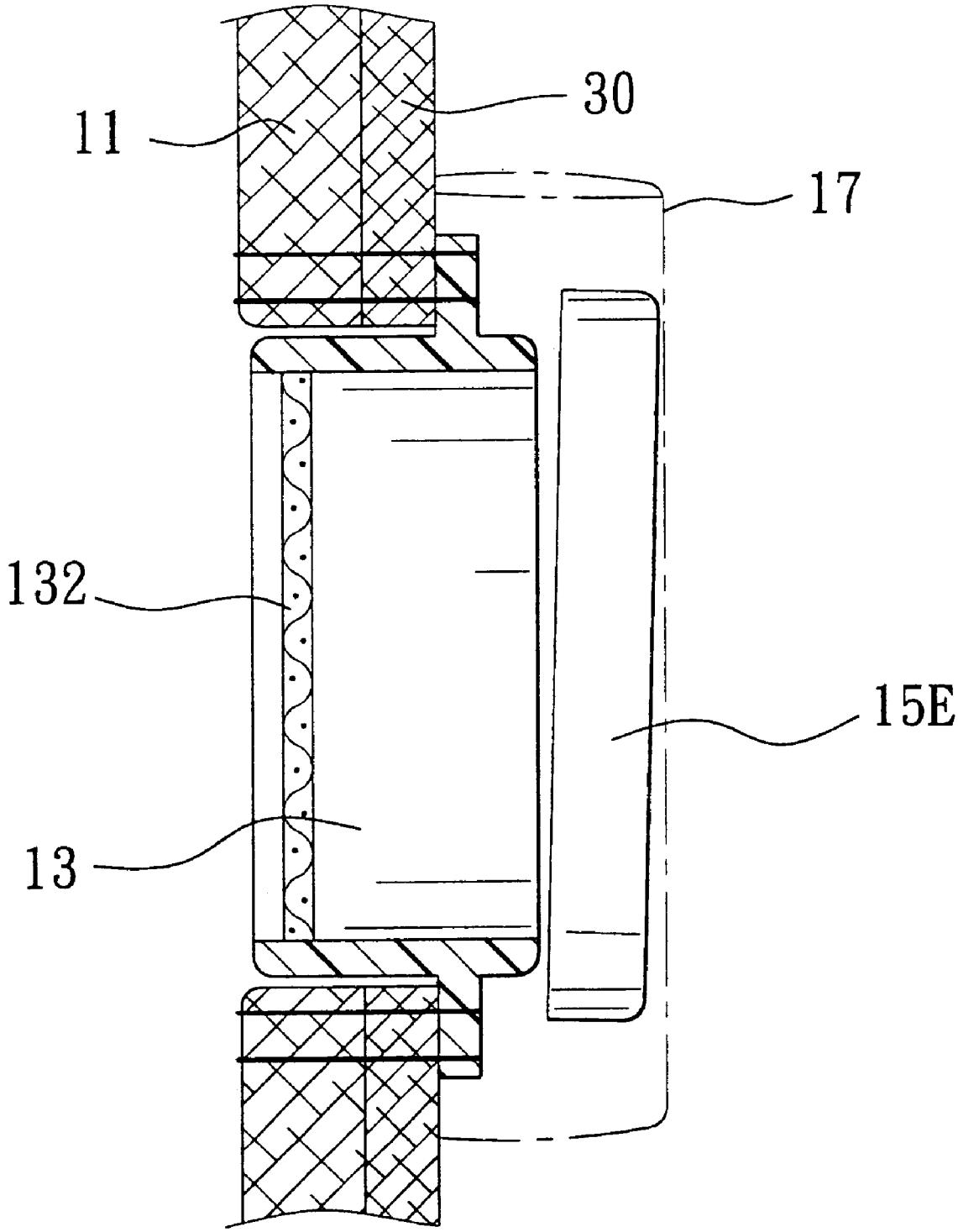
FIG. 10 is a sectional view showing an inside lid disposed inside a shoe body to close the hollow base.

Referring to FIG. 10, a hollow base 13 is inserted into and fixed to an upper 11 and a lining 30. A lid 15E is press-fitted to the hollow base 13 from the inside of a shoe body (not shown) for closing the hollow base 13. A pocket 17 is attached to the lining 30 to cover the lid 15E or to prevent the wearer's foot from contacting directly the lid 15E. The hollow base 13 is opened when the lid 15E is removed from the hollow base 13.

Figure 11:
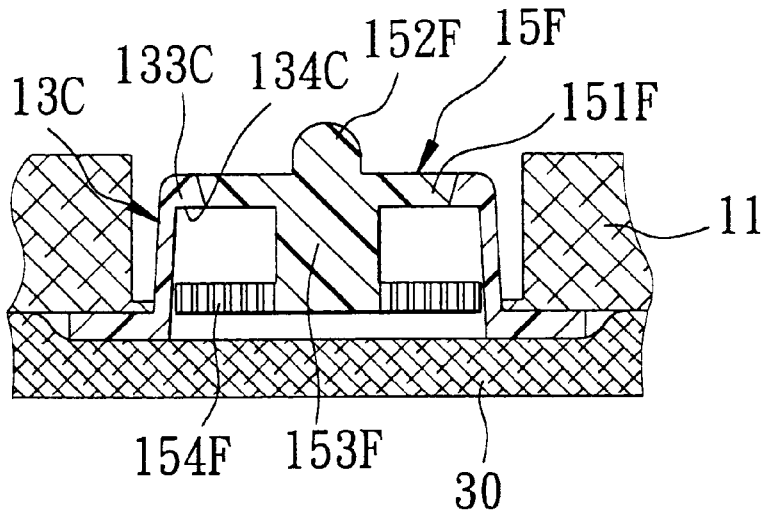
FIG. 11 is a sectional view illustrating a lid having a lid body having a stem connected to a screen.
Figure 12:
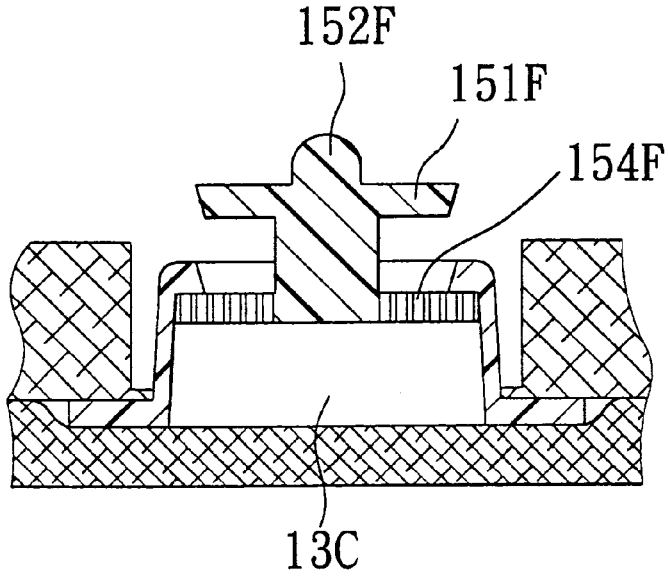
FIG. 12 is the same view as FIG. 11 but with the lid body being pulled outward.

Referring to FIGS. 11 and 12, the upper 11 may be provided with a hollow base 13C which is covered by a lid 15F. The hollow base 13C has a narrow open end part 133C at an outer open end thereof and an annular shoulder 134C formed inwardly of the narrow open end part 133C. The lid 15F includes a lid body 151F having an integral knob 152F projecting from one side of the lid body 151F, a stem 153F projecting from an opposite side of the lid body 151F, and a screen 154F held by a bottom end of the stem 153F. The lid body 151F can be plugged in the narrow open end part 133C to block the hollow base 13C. When the lid body 151 is pulled out via the knob 152F from the narrow open end part 133C, the screen 154F abuts against the shoulder 134C. In this situation, the hollow base 13C is opened to permit passage of water or air through the screen 154F.

Figure 13:
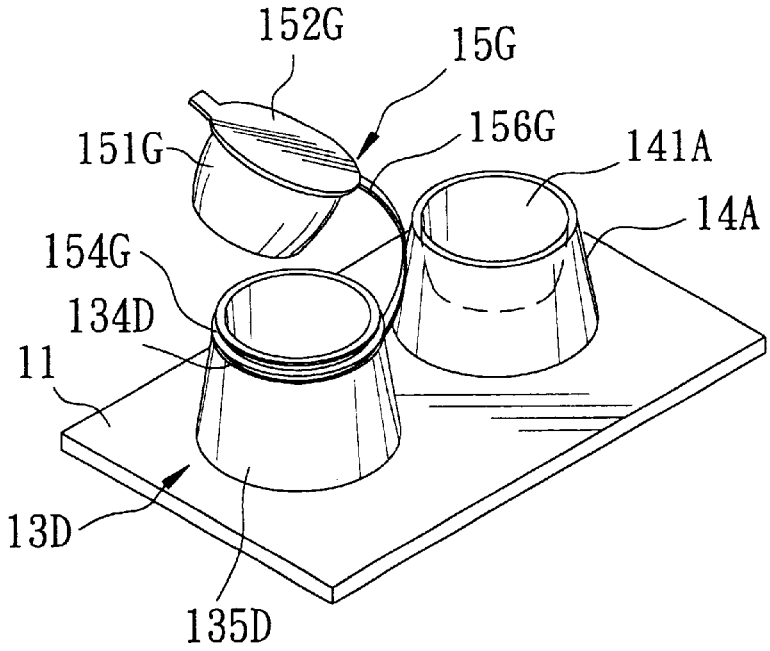
FIG. 13 is a perspective view illustrating a lid having a lid body connected to a ring via a strap.
Figure 14:
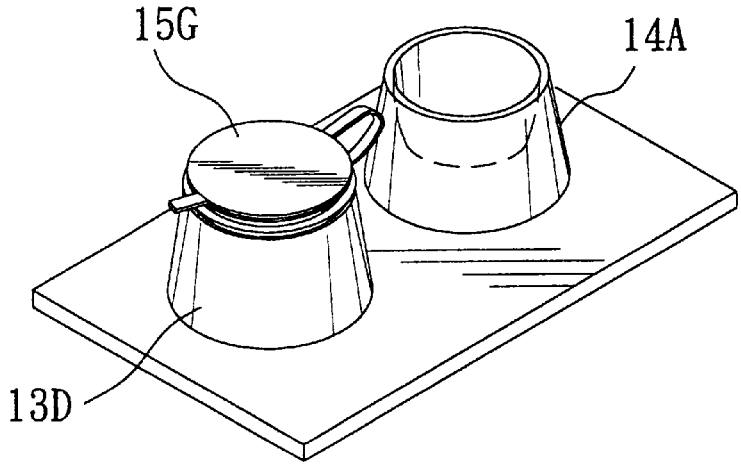
FIG. 14 is the same view as FIG. 13 but with the lid body plugged in a hollow base.
Figure 15:
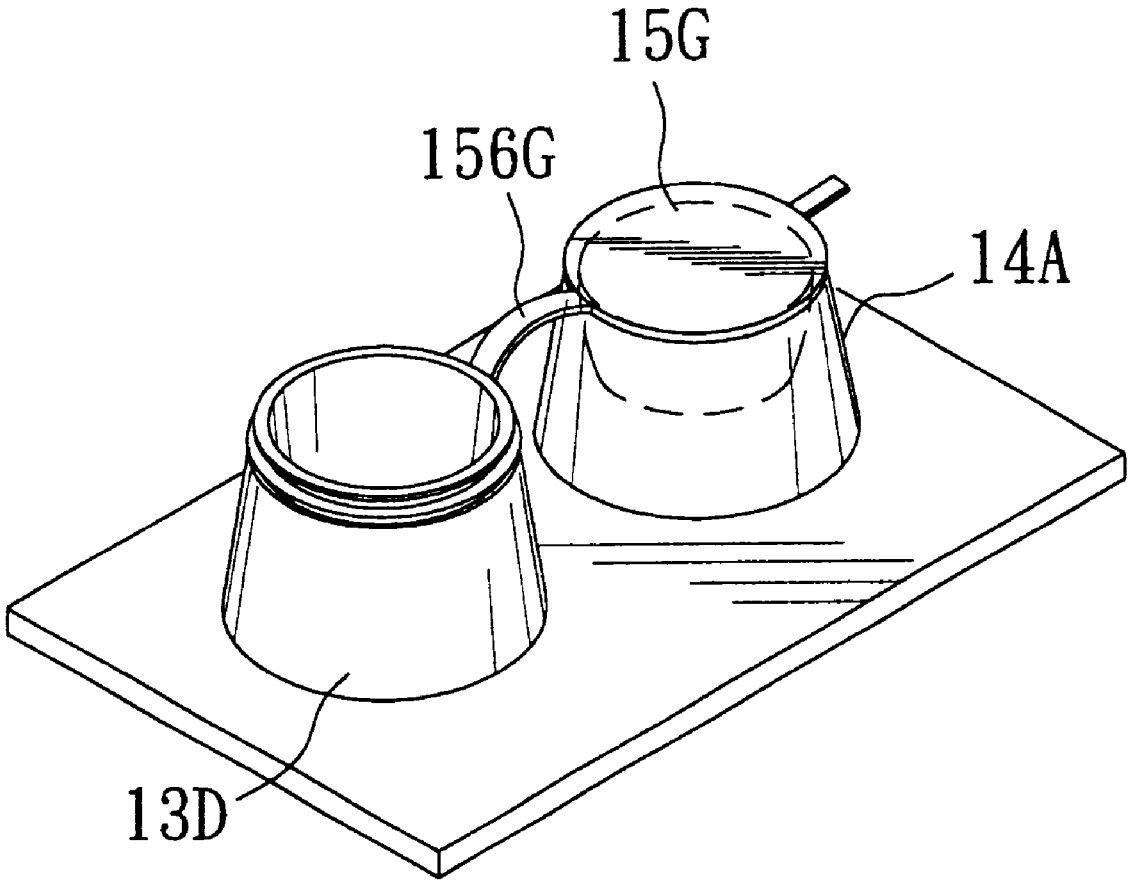
FIG. 15 is the same view as FIG. 13 but with the lid body plugged in a cavity of a stud.

Referring to FIGS. 13, 14 and 15, the upper 11 is provided with a hollow base 13D and a stud 14A. The hollow base 13D has an annular recess 134D extending in an outer face of an annular wall 135D. The stud 14A has a blind hole 141A. A lid 15G has a lid body 151G plugged in the hollow base 13D. The lid 15G further includes a cap plate 152G formed integrally with the lid body 151G, an attachment ring 154G received movably in the annular recess 134D and connected to the cap plate 152G via a strap 156G. When the lid body 151G is plugged in the hollow base 13D, the hollow base 13D is closed. When the lid body 151G is removed from the hollow base 13D and fitted in the blind hole 141A of the stud 14A, the hollow base 13D is opened.

Figure 16:
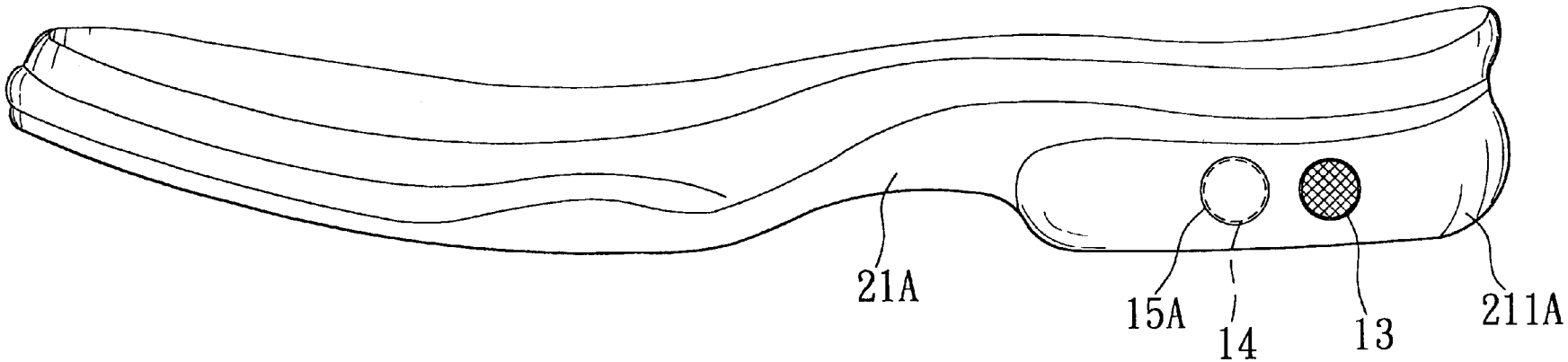
FIG. 16 shows an outsole provided with a hollow base and a stud according to the present invention.

Referring to FIG. 16, like the outsole 21 shown in FIG. 5, a heel section 211A of a midsole 21A may be provided with a lid 15A, a stud 14 and a hollow base 13.

As described hereinbefore, the lids 15, 15A, 15C, 15E, 15F, 15G according to the present invention can block fluid passages provided by the hollow bases 13, 13A, 13B, 13C. In addition, these lids 15, 15A, 15C, 15E, 15F, 15G can also serve to hold advertising logos or teams' logos. The logos may be changed when desired since the lids are removable. These lids may be made of a transparent material or a luminescent material for decorative purposes. When the lids are provided at the bottom of an outsole, they may be fabricated from a high abrasion-resistant material. When the lids are made of rubber having a high coefficient of friction, the lids may be used as traction members for an outsole.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoe comprising:

a shoe body including at least one through-hole extending from an inside to an outside of said shoe body;

at least one hollow base fixed in said through-hole and having an inner end at the inside of said shoe body and an outer end opposite to said inner end, said hollow base being hollow from said inner end to said outer end for passage of a fluid;

a lid attached removably to said hollow base so as to block said hollow base; and wherein said lid includes a hollow lid holder press-fitted removably in said hollow base, and a lid body hinged to said lid holder and pluggable in said lid holder.

2. A shoe comprising:

a shoe body including at least one through-hole extending from an inside to an outside of said shoe body;

at least one hollow base fixed in said through-hole and having an inner end at the inside of said shoe body and an outer end opposite to said inner end, said hollow base being hollow from said inner end to said outer end for passage of fluid and including a tubular wall having an end rim;

a lid attached removably to said hollow base so as to block said hollow base; and wherein said lid includes a lid body pluggable in said hollow base, an attachment ring mounted on said hollow base, and a strap interconnecting said lid body and said attachment ring.

3. The shoe as claimed in claim 2, further comprising a stud mounted on said shoe body adjacent to said hollow base, said stud having a blind hole to receive removably said lid body, said lid body being received selectively in one of said blind hole and said hollow base.

4. A shoe comprising:

a shoe body including at least two through-holes extending from an inside to an outside of said shoe body;

a pair of hollow bases respectively fixed within said through-holes and each having an inner end at the inside of said shoe body and an outer end opposite to said inner end, each of said hollow bases being hollow form said inner end to said outer end for passage of a fluid, each of said hollow bases having an end rim;

a solid stud mounted on said shoe body adjacent to said hollow bases and having a lateral rim, said stud and said hollow bases being respectively arranged at three locations which define substantially three vertices of an equilateral triangle; and a single-piece lid for covering removably said hollow bases, said lid being long enough to bridge either said two hollow bases or one of said hollow bases and said solid stud, said lid including two closure parts and a connection part interconnecting said closure parts, each of said closure parts being engageable with either said end rim of one of said hollow bases or said lateral rim of said hollow stud.

5. The shoe as claimed in claim 4, wherein each of said closure parts has a looped groove to engage releasably either of said end rim of one of said hollow bases or said lateral rim of said stud.

* * * * *